US007264752B2

(12) United States Patent
Drappel

(10) Patent No.: US 7,264,752 B2
(45) Date of Patent: Sep. 4, 2007

(54) CONDUCTIVE COATINGS FOR CORONA GENERATING DEVICES

(75) Inventor: Stephan V. Drappel, Toronto (CA)

(73) Assignee: Xerox Corporation, Stamford, CT (US)

( * ) Notice: Subject to any disclaimer, the term of this patent is extended or adjusted under 35 U.S.C. 154(b) by 393 days.

(21) Appl. No.: 10/650,743

(22) Filed: Aug. 29, 2003

(65) Prior Publication Data

US 2005/0048209 A1 Mar. 3, 2005

(51) Int. Cl.
*H01B 1/08* (2006.01)
*H01T 19/00* (2006.01)
*G03G 15/00* (2006.01)

(52) U.S. Cl. ..... 252/500; 252/518.1; 252/519.1; 250/326; 250/324; 361/225; 361/229; 361/212; 430/937; 430/202; 427/372.2; 355/221

(58) Field of Classification Search ..... 252/500, 252/502, 511, 518.1; 106/1.13; 428/454, 428/390, 370; 427/101, 372.2; 250/326.324; 313/450; 361/229, 225; 399/100, 311, 170, 399/302; 430/31, 108.6, 937, 902
See application file for complete search history.

(56) References Cited

U.S. PATENT DOCUMENTS

| | | | | |
|---|---|---|---|---|
| 2,836,725 | A | 5/1958 | Vyverberg | |
| 3,789,278 | A * | 1/1974 | Bingham et al. | 361/229 |
| 3,923,697 | A * | 12/1975 | Ellis | 252/506 |
| 4,052,641 | A * | 10/1977 | Dominick et al. | 313/450 |
| 4,086,650 | A | 4/1978 | Davis et al. | |
| 4,251,749 | A * | 2/1981 | Compen et al. | 313/479 |
| 4,401,579 | A | 8/1983 | Kratzer | |
| 4,517,118 | A | 5/1985 | Stoetzer | |
| 4,585,322 | A * | 4/1986 | Reale | 250/325 |
| 4,646,196 | A | 2/1987 | Reale | |
| 4,765,917 | A | 8/1988 | Otaki et al. | |
| 4,806,272 | A | 2/1989 | Wiley | |
| 4,894,296 | A * | 1/1990 | Borbely et al. | 429/27 |
| 4,920,266 | A | 4/1990 | Reale | |
| 5,147,460 | A | 9/1992 | Otaki | |
| 5,160,375 | A | 11/1992 | Otaki | |
| 5,389,403 | A | 2/1995 | Buckley et al. | |
| 6,793,729 | B2 * | 9/2004 | Lee | 106/600 |
| 2004/0155188 | A1 * | 8/2004 | Kohli et al. | 250/338.1 |

OTHER PUBLICATIONS

"Corona", Condensed Dictionary, 14th Ed, 2002, p. 1.*
"Corona", Wikipedia, 2006, pp. 1-4.*

* cited by examiner

*Primary Examiner*—Douglas McGinty
*Assistant Examiner*—Kallambella Vijayakumar
(74) *Attorney, Agent, or Firm*—Oliff & Berridge, PLC

(57) ABSTRACT

Conductive coatings usable for coating various elements of corona generating devices and method of forming such coatings are provided. The coatings include graphite and at least one transition metal oxide catalyst. When the conductive coatings are employed in elements of corona generating devices and the devices are activated, the conductivity of the elements is maintained in a manner that preserves the ability of a photoreceptor in an image forming device to retain an image charge in a fashion sufficient to allow subsequent development with toner. The coatings also function to scavenge ozone and neutralize nitrogen oxides formed during operation of corona generating devices. Corona generating devices including elements having such coatings are also provided.

18 Claims, 5 Drawing Sheets

CONDUCTIVE COATINGS FOR CORONA GENERATING DEVICES

BACKGROUND OF THE INVENTION

1. Field of Invention

The present invention is directed to conductive coatings for corona generating devices, methods for forming such coatings and corona generating devices employing such coatings.

2. Description of Related Art

In electrostatographic reproducing apparatuses commonly used today, a photoconductive insulating member may be charged to a negative potential, and thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted by the charge pattern of the image areas on the photoconductive insulating area to form a powder image on the photoconductive area. This image may be subsequently transferred to a support surface such as paper to which it may be permanently affixed by application of heat and/or pressure. Following transfer of the toner image to the support surface, the photoconductive insulating surface may be discharged and cleaned of residual toner to prepare for the next imaging cycle.

Various types of charging devices have been used to charge or precharge photoconductive insulating layers. In commercial use, for example, are various types of corona generating devices in which a high voltage of 5,000 to 8,000 volts may be applied to the device thereby producing a corona spray which imparts electrostatic charge to the surface of the photoreceptor. One particular device, known as a corotron, takes the form of a single corona wire strung between insulating end blocks mounted on either end of a channel or shield. Another device, which is frequently used to provide more uniform charging and to prevent overcharging, is a scorotron. A scorotron comprises two or more corona wires with a control grid or screen of parallel wires or apertures in a plate positioned between the corona wires and the photoconductor. A potential is applied to the control grid of the same polarity as the corona potential but with a much lower voltage, usually several hundred volts, which supresses the electric field between the charge plate and the corona wires and markedly reduces the ion current flow to the photoreceptor.

A known corona generating device is described in U.S. Pat. No. 4,086,650, incorporated herein by reference in its entirety, commonly referred to in the art as a dicorotron wherein the corona discharge electrode is coated with a relatively thick dielectric material such as glass so as to substantially prevent the flow of conduction current therethrough. The delivery of charge to the photoconductive surface is accomplished by means of a displacement current or capacitive coupling through the dielectric material. The flow of charge to the surface to be charged is regulated by means of a DC bias applied to the corona shield. In operation, an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and therefore does not have to be repeatedly cleaned.

In the dicorotron device described above, the dielectric coated corona discharge electrode is a coated wire supported between insulating end blocks and the device has a conductive auxiliary DC electrode positioned opposite to the imaging surface on which the charge is to be placed. In the conventional corona discharge device, the conductive corona electrode is also in the form of an elongated wire connected to a corona generating power supply and supported by end blocks with the wire being partially surrounded by a conductive shield which is usually electrically grounded. The surface to be charged is spaced from the wire on the side opposite the shield and is mounted on a conductive substrate.

In addition to the desirability to negatively charge one type of photoreceptor, it often is desired to provide a negative precharge to another type photoreceptor such as a selenium alloy prior to its being actually positively charged. A negative precharging is used to neutralize the positive charge remaining on the photoreceptor after transfer of the developed toner image to the copy sheet and cleaning to prepare the photoreceptor for the next copying cycle. Typically in such a precharge corotron, an AC potential of between 4,500 and 6,000 volts rms at 400 to 600 Hz may be applied. A typical conventional corona discharge device of this type is shown generally in U.S. Pat. No. 2,836,725, incorporated herein by reference in its entirety, in which a conductive corona electrode in the form of an elongated wire is connected to a corona generating AC voltage.

In operation of the above described corona generating devices, certain difficulties arise as a result of byproducts that are generated in the atmosphere surrounding the devices and adsorbed on various surfaces of the devices. In particular, operation of these devices results in the formation of nitrogen oxide species, and subsequently ozone, according to the following reaction scheme:

$$NO_2 + h\nu \rightarrow NO + O$$

$$O + O_2 \rightarrow O_3$$

The creation of these byproducts adversely affects print quality by altering the conductivity of various elements of the corona generating devices and, in turn, affecting the photoreceptor in such a way as to prevent the photoreceptor from retaining an image charge in a fashion sufficient to allow subsequent development with toner. This defect can cause narrow line images to blur or to wash out and not be developed as a toner image. In addition to the effects on print quality, the produced ozone is extremely harmful to the environment. Ozone is involved in a number of reactions with hydrocarbons in the atmosphere that result in formation of free radicals and other intermediates that ultimately lead to creation of still further environmental pollutants. In addition, the ozone can degrade and/or cause cracks to form in surfaces of a corona generating device including a polymeric component.

Several approaches to countering the effects of the above-described byproducts of operation of corona generating devices have been posited. One such approach is described in U.S. Pat. Nos. 4,646,196 and 4,920,266, which are incorporated herein by reference in their entireties. This approach involves coating surfaces of corona generating devices with aluminum hydroxide to neutralize the nitrogen oxide species that may be generated when a dicorotron is energized. This approach has been modified in practice through the addition of nickel powder to the coating as, for example, in the DAG coating, which is available from Acheson Colloid Company, Port Huron, Mich. Similar coatings and lubricants are described in U.S. Pat. Nos. 4,401,579, 4,517,118, 4,765,917, 4,806,272, 5,147,460, 5,160,375 and 5,389,403, which are incorporated herein by reference in their entireties. As these formulations neutralize the nitrogen oxide species occurring as a result of operation of corona generating devices, they limit the adverse effects on the conductivity of the various elements of the corona generating devices and, thus, limit degradation of print quality. In addition, these approaches limit the undesirable emission of ozone into the atmosphere.

SUMMARY OF THE INVENTION

Notwithstanding the aforementioned advantages of known approaches of countering the effects of the above-described byproducts of operation of corona generating devices, those approaches are deficient. Such deficiencies relate to the use of nickel powder and aluminum hydroxide. Nickel powder is known to be a health hazard, and its use creates regulatory obstacles relating to disposal of the powder. Aluminum hydroxide, when mixed with polymeric binders that are commonly used in conductive coating dispersions, has a limited shelf life. Aluminum hydroxide will often form irreversible gels with such binders, making the resulting dispersions unevenly viscous, and thus impossible to apply as coatings.

In view of the above-described shortcomings of known approaches of countering the effects of the byproducts of operation of corona generating devices, a new coating is needed that can be consistently manufactured at an appropriate viscosity for application, and that is not an environmental or health hazard.

In various exemplary embodiments, conductive coatings and methods of forming conductive coatings are provided. The conductive coatings are usable on an element in a corona generating device, the coatings including graphite and at least one transition metal oxide catalyst. When the conductive coatings are employed in an element of a corona generating device and the device is activated, the conductivity of the element is maintained in a manner that preserves the ability of a photoreceptor in an image forming device to retain an image charge in a fashion sufficient to allow subsequent development with toner. The coating also functions to scavenge ozone and neutralize nitrogen oxides formed during operation of the corona generating device.

In various exemplary embodiments, a corona generating device is provided including at least one element, the element including a conductive coating including graphite and at least one transition metal oxide catalyst.

In various exemplary embodiments, an image forming device is provided, the image forming device including a corona generating device having at least one element including a conductive coating of graphite and at least one transition metal oxide catalyst.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein.

DETAILED DESCRIPTION OF PREFERRED EMBODIMENTS

Figure 1:
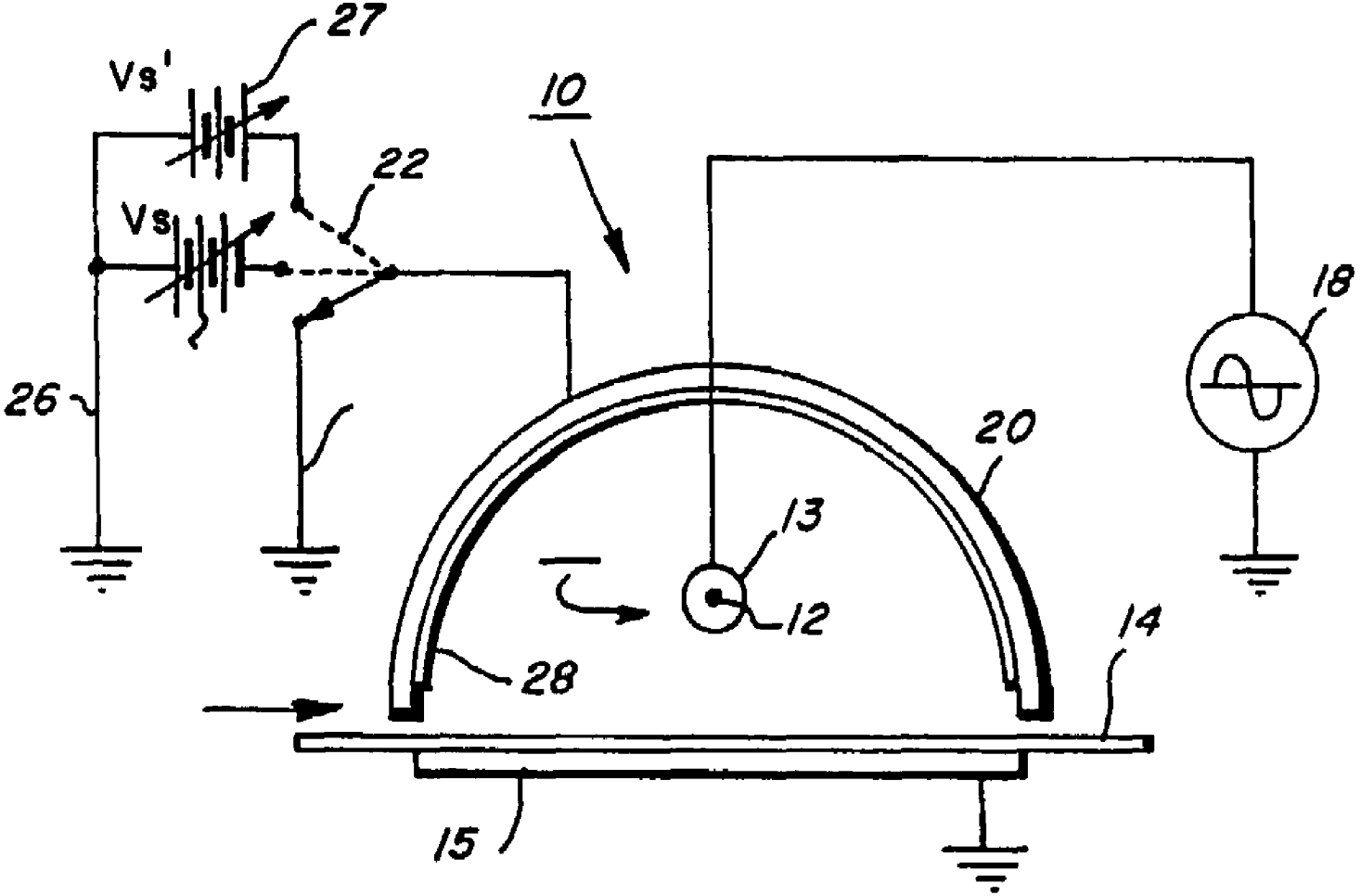
FIG. 1 is an illustrative cross section of a corona generating device according to the present invention.

Referring to FIG. 1, in various exemplary embodiments, the corona generator 10 of this invention includes a corona discharge electrode 11 in the form of a conductive wire 12 having a relatively thick coating 13 of dielectric material.

A charge collecting surface 14 is shown which may be a photoconductive surface in a conventional xerographic systems. In various exemplary embodiments, the charge collecting surface 14 is carried on a conductive substrate 15 held at a reference potential, usually machine ground. An AC voltage source 18 can be connected between the substrate 15 and the corona wire 12, the magnitude of the AC source being selected to generate a corona discharge adjacent the wire 12. A conductive shield 20 can be located adjacent the corona wire on the side of the wire opposite the chargeable surface.

In various exemplary embodiments, the shield 20 is coupled to a switch 22 which, depending on its position, permits the corona device to be operated in either a charge neutralizing mode or a charge deposition mode. With the switch 22 as shown, the shield 20 of the corona device can be coupled to ground via a lead 24. In this position, no DC field is generated between the surface 14 and the shield 15 and the corona device operates to neutralize over a number of AC cycles any charge present on the surface 14.

In various exemplary embodiments, when the switch 22 is in either of the positions shown by dotted lines, the shield is coupled to one terminal of a DC source 23 or 27, the other terminals of the sources being coupled to lead 26 to ground thereby establish a DC field between the surface 14 and the shield 20. In this position, the corona operates to deposit a net charge onto the surface 14, the polarity and magnitude of this charge depends on the polarity and magnitude of the DC bias applied to the shield 20.

In various exemplary embodiments, the corona wire 13 is supported in conventional fashion at the ends thereof by insulating end blocks (not shown) mounted within the ends of shield structure 20. The wire 12 may be made of any conventional conductive filament material such as stainless steel, gold, aluminum, copper, tungsten, platinum or the like. The diameter of the wire 11 is not critical and, in various exemplary embodiments, is between 0.5 and 15 mils. In some such embodiments, the diameter of the wire 11 is about 9 mils.

Any suitable dielectric material may be employed as the coating 13 which will not break down under the applied corona AC voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

In various exemplary embodiments, the thickness of the dielectric coating 13 used in the corona device of the invention is such that substantially no conduction current or DC charging current is permitted therethrough. In some such embodiments, the thickness is such that the combined wire and dielectric thickness falls in the range from 7 to 30 mils and the thickness of the dielectric is from 2 to 10 mils. Glasses with dielectric breakdown strengths above 2 KV/mil at 4 KHz and in the range of 2 to 5 mil thickness have been found by experiment to perform satisfactorily as the dielectric coating material. As the frequency or thickness decreases, the strength in volts per mil will usually increase. The glass coating selected should be free of voids and inclusions and make good contact with or wet the wire on which it is deposited. Other possible coatings are ceramic materials such as alumina, zirconia, boron nitride, beryllium oxide and silicon nitride. Organic dielectrics that are sufficiently stable in corona may also be used.

The frequency of the AC source 18 may be varied widely in the range from 60 Hz to several megahertz. The device has been operated and tested at 4 KHz and found to operate satisfactorily.

The shield 20 is shown as being semi-circular in shape but any of the conventional shapes used for corona shields in xerographic charging may be employed. In fact, the function of the shield 20 may be performed by any conductive member, for example, a base wire, in the vicinity of the wire, the precise location not being critical in order to obtain satisfactory operation of the device.

In various exemplary embodiments, the switch 22 is connected as shown so that the shield 20 is grounded and the device operates to inherently neutralize any charge present on the surface 14. This is a result of the fact that no net DC charging current passes through the electrode 11 by virtue of the thick dielectric coating 13 and the wire 12.

Referring to FIG. 1, in various exemplary embodiments, operation of the corona device of the invention to deposit a specific net charge on an imaging surface is accomplished by moving switch 22 to one of the positions shown in dotted lines, whereby a DC potential of either positive polarity or negative polarity with respect to the surface 15 may be applied to the shield.

In charging operation, typical AC voltages applied to the corona electrodes are in the range from 4 KV to 7 KV at a frequency between 1 KHz and 10 KHz. With the conductive substrate of the imaging member being held at ground potential a negative DC bias of from about 800 volts to about 4 KV is applied to the shield. For further details of the manner of operation of the above described dicorotron device are provided in U.S. Pat. Nos. 4,086,650, 4,646,196 and 4,920,196, each of which is incorporated herein by reference in its entirety.

Referring once again to FIG. 1, the shield 20 is coated at least on its top with a conductive coating 28. Like the known coating compositions discussed above, the conductive coating 28 functions to stabilize the conductivity in various elements of a corona generating device in a manner that preserves the ability of a photoreceptor to retain an image charge in a fashion sufficient to allow subsequent development with toner. Further, the conductive coating 28 functions as an ozone scavenger to prevent the exhaust of ozone into the atmosphere, and neutralizes nitrogen oxides. In various exemplary embodiments, the conductive coating 28 according to the present invention includes graphite and at least one transition metal oxide catalyst. Graphite imparts conductivity to the conductive coating 28. The at least one transition metal oxide catalyst is a catalyst that performs oxidation of unwanted and harmful contaminants. As a constituent of the conductive coating 28 in a corona generating device, the at least one transition metal oxide catalyst neutralizes nitrogen oxides and operates as an ozone scavenger to prevent the exhaust of ozone into the atmosphere and produce oxygen. In various exemplary embodiments, the conductive coating 28 may also include a humidity tolerance-enhancing agent. The humidity tolerance-enhancing agent, of course, functions to improve the humidity tolerance of the conductive coating 28.

In various exemplary embodiments, the conductive coating 28 is applied the surface or item to be coated in an aqueous medium providing a somewhat viscous coating which is subsequently readily dehydrated by driving off the water. In various exemplary embodiments, the aqueous medium includes a graphite dispersion and at least one transition metal oxide catalyst. The graphite dispersion can be any graphite dispersion suitable for forming a conductive coating in a corona generating device. The graphite dispersion can include graphite, a binder, water and/or a biocide. Various generally available graphite dispersions can be used in the aqueous medium. Some such generally available aqueous graphite dispersions include, but are not limited to, one or more of LB 1000, LB 1010, LB 1300, ROLLIT DS 8832 MT, ROLLIT DS 1050 MT and ROLLIT DS 1150 MT, which are available from TIMCAL America Inc., Westlake, Ohio, AQUANET SM and AQUANET LM, which are available from NGS Naturgraphit GmbH, Leinburg, Germany, Suspensions #81120, #81021A, #81024, #81225, #81230, #81440 and #81445 and GRAPHILM, which are available from Asbury Graphite Mills, Asbury, N.J. and 130 Suspension, 135 Suspension, SURECOAT (R) 430 AND SURECOAT (R) 1530, which are available from Superior Graphite, Chicago, Ill. In various exemplary embodiments, the aqueous medium includes ROLLIT DS 8832 MT.

The at least one transition metal oxide catalyst can be any transition metal oxide catalyst suitable for preventing ozone formation in a corona generating device. In various exemplary embodiments, the at least one transition metal oxide catalyst includes one or more of manganese dioxide, copper oxide and a support. In some such embodiments, the at least one transition metal oxide catalyst includes manganese dioxide, copper oxide and a support. The at least one transition metal oxide catalyst can be provided in any known available form. In various exemplary embodiments, the at least one transition metal oxide catalyst is provided in a powdered form, having a high surface area, and thus high reactivity. Various generally available catalyst preparations can be employed in the aqueous medium. For example, the catalyst MOLECULITE, which is available from Molecular Products, Ltd., United Kingdom, can be employed. MOLECULITE is believed to be a mixture of transition metal oxides including less than 90 weight percent manganese dioxide (CAS#1313-13-9) and less than 45 weight percent copper oxide (CAS#1317-38-0). Commercial sources for manganese dioxide include, but are not limited to, Chemalloy, Bryn Mawr, Penn., Hummel Croton, South Plainfield, N.J., Kerr-McGee Chemical LLC, Oklahoma City, Okla., Cerac, Milwaukee, Wis., Lorad Chemical, St. Petersburg, Fla., Mallinckrodt Baker, Phillipsburg, N.J. and Spectrum Laboratory Products, Gardena Calif. Commercial sources of copper oxide include, but are not limited to, American Chemet, Deerfield, Ill., Belmont Metals, Brooklyn, N.Y., GFS Chemicals, Powell, Ohio, Mallinckrodt Baker, Phillipsburg, N.J. and Spectrum Laboratory Products.

The aqueous medium can also include a humidity tolerance-enhancing agent. In various exemplary embodiments, the humidity tolerance-enhancing agent is one or more of sodium silicate and potassium silicate. The sodium silicate and/or potassium silicate can be provided in any form that is suitable to impart humidity resistance to the conductive coating 28. In various exemplary embodiments, the sodium silicate and/or potassium silicate are provided in aqueous preparations. Various generally available preparations of aqueous sodium silicate and/or aqueous potassium silicate can be used in the aqueous medium. Some such preparations include aqueous sodium silicate solutions such as K available from National Silicates, an affiliate of PQ Corporation, Valley Forge, Penn. Other sodium silicate solutions include *N, E, *O, M, *STAR, *RU, RU44 and D. Potassium silicate solutions can include products such as KASIL No. 1, KASIL No. 6 and KASIL No. 33.

In addition to the above described components, water can be added to the aqueous medium to adjust the viscosity of the medium. By adjusting the viscosity with water as necessary, an aqueous medium can be provided that is capable of forming a substantially uniform layer during application of the medium, whether by spraying, dip coating or brushing, as with paint. Coating a particular surface with such a substantially uniform layer permits formation of a coherent film on that surface.

In various exemplary embodiments, the aqueous medium includes the graphite dispersion, the at least one transition metal oxide catalyst, the humidity tolerance-enhancing agent and water in sufficient respective quantities to impart the desired ozone scavenging, nitrogen oxide neutralizing and conductivity maintenance characteristics to the conductive coating 28. In various exemplary embodiments, the aqueous medium includes from about 30 to about 50 weight percent of the graphite dispersion. In some such embodiments, the aqueous medium includes from about 35 to about 45 weight percent of the graphite dispersion. In still further embodiments, the aqueous medium includes from about 40 to about 45 weight percent of the graphite dispersion. In various exemplary embodiments, the aqueous medium includes from about 5 to about 25 weight percent of the at least one transition metal oxide catalyst. In some such embodiments, the aqueous medium includes from about 10 to about 20 weight percent of the at least one transition metal oxide catalyst. In further embodiments, the aqueous medium includes from about 10 to about 15 weight percent of the at least one transition metal oxide catalyst. In various exemplary embodiments, the aqueous medium includes less than about 10 weight percent of the humidity tolerance-enhancing agent. In some such embodiments, the aqueous medium includes less than about 10 weight percent of the humidity tolerance-enhancing agent. In further embodiments, the aqueous medium includes from about 1 to about 3 weight percent of the humidity tolerance-enhancing agent. In various exemplary embodiments, the aqueous medium includes from about 30 to about 50 weight percent of water. In some such embodiments, the aqueous medium includes from about 35 to about 45 weight percent of water. In still further embodiments, the aqueous medium includes from about 40 to about 45 weight percent water.

The conductive coating of graphite and at least one transition metal oxide catalyst may be formed on the article to be coated by applying an aqueous solution or dispersion as a thin film thereto. Upon drying, the liquid films dehydrate to provide a strong rigid inorganic adhesive bond to the substrate. Typically the films can be applied by spraying or brushing as with a paint so as to provide a coherent film on the shield.

In order to maintain the conductivity of various elements of the corona generating device while preventing formation of ozone, the conductive coating 28 should be formed so as to have a thickness sufficient to prevent consumption of the at least one transition metal oxide catalyst at a rate that would limit the operation of the device. In various exemplary embodiments, the conductive coating 28 is formed to have a thickness of at least about 5 microns. In some such embodiments, the conductive coating 28 is formed to have a thickness of at least about 20 microns. In further embodiments, the conductive coating 28 is formed to have a thickness of from about 20 to about 50 microns. In still further embodiments, the conductive coating 28 is formed to have a thickness of about 25 microns. Generally, it is desirable that the conductive coating 28 be formed so as to be substantially continuous and without pores.

Figure 2:
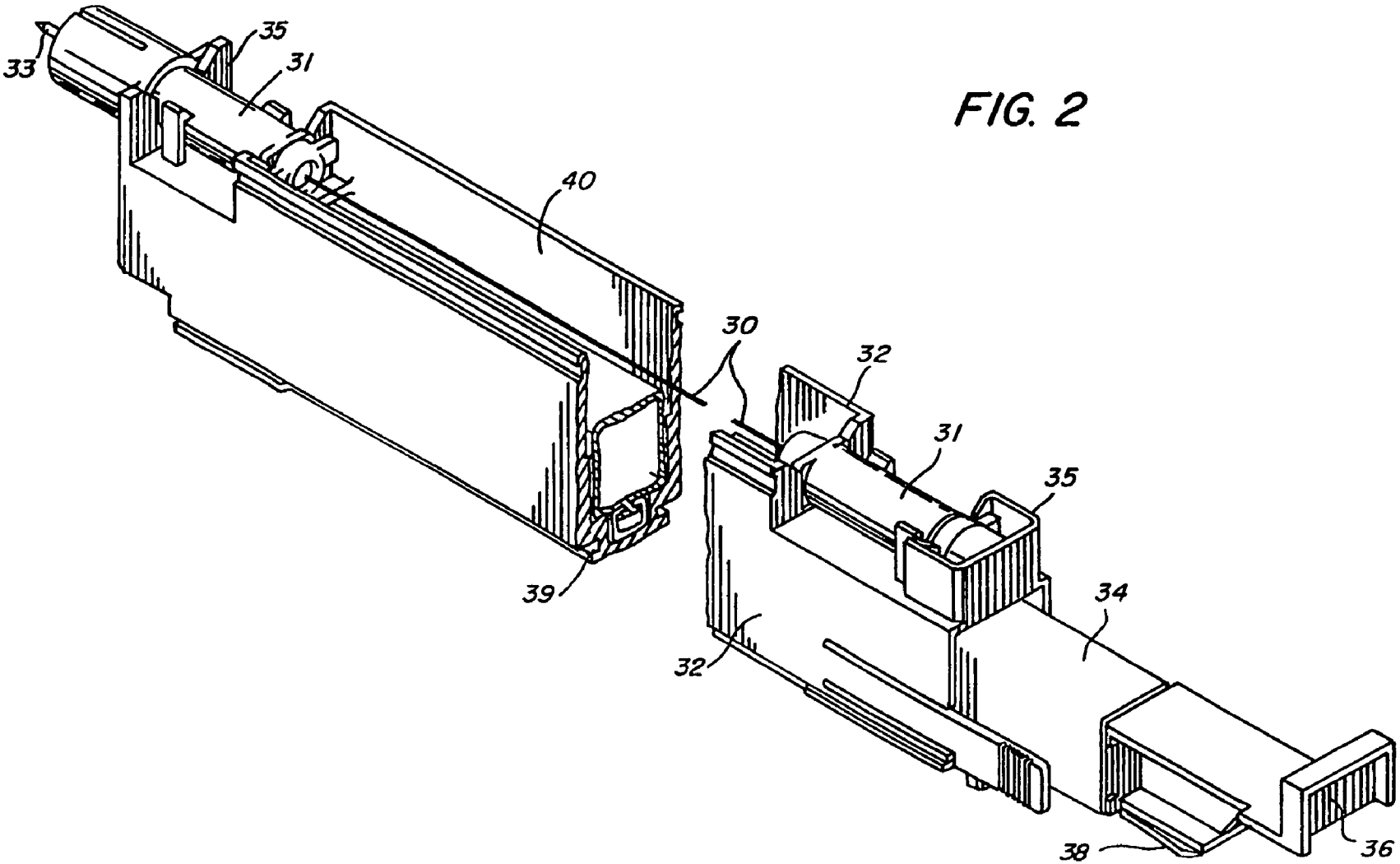
FIG. 2 is an isometric view of an exemplary embodiment of a dicorotron according to the present invention.

FIG. 2 illustrates an exemplary embodiment of a dicorotron device according to the present invention. In FIG. 2, the dicorotron wire 30 is supported between anchors 31 at opposite ends which are anchored in end blocks 35. The conductive shield 34 is constructed in tubular fashion in such a way as to be slideably mounted in the bottom of the housing 39 by means of handle 36. The shield is connected to the power supply through a sliding contact on its inner surface to a leaf spring which in turn is connected to a DC pin connector (not shown). The power supply potential may be positive, negative, or zero (grounded) depending on device function. It is fastened in place when inserted within the housing 39 by means of spring retaining member 38. When inserted in the machine, high voltage contact pin 33 provides the necessary contact to the AC power supply. In addition to the conductive shield 34, the housing 39 comprises two vertically extending side panels 32 extending the entire length of the dicorotron wire. Both the top and inner surfaces of the shield 34 may have a conductive coating of graphite and at least one transition metal oxide catalyst. In addition, the vertically extending panels 32 of the housing 39 may also be coated with a conductive coating 40 of graphite and at least one transition metal oxide catalyst. The housing 39 together with the side panels 32 may be made from a single one piece molding from any suitable material such as glass filled polycarbonate.

Figure 3:
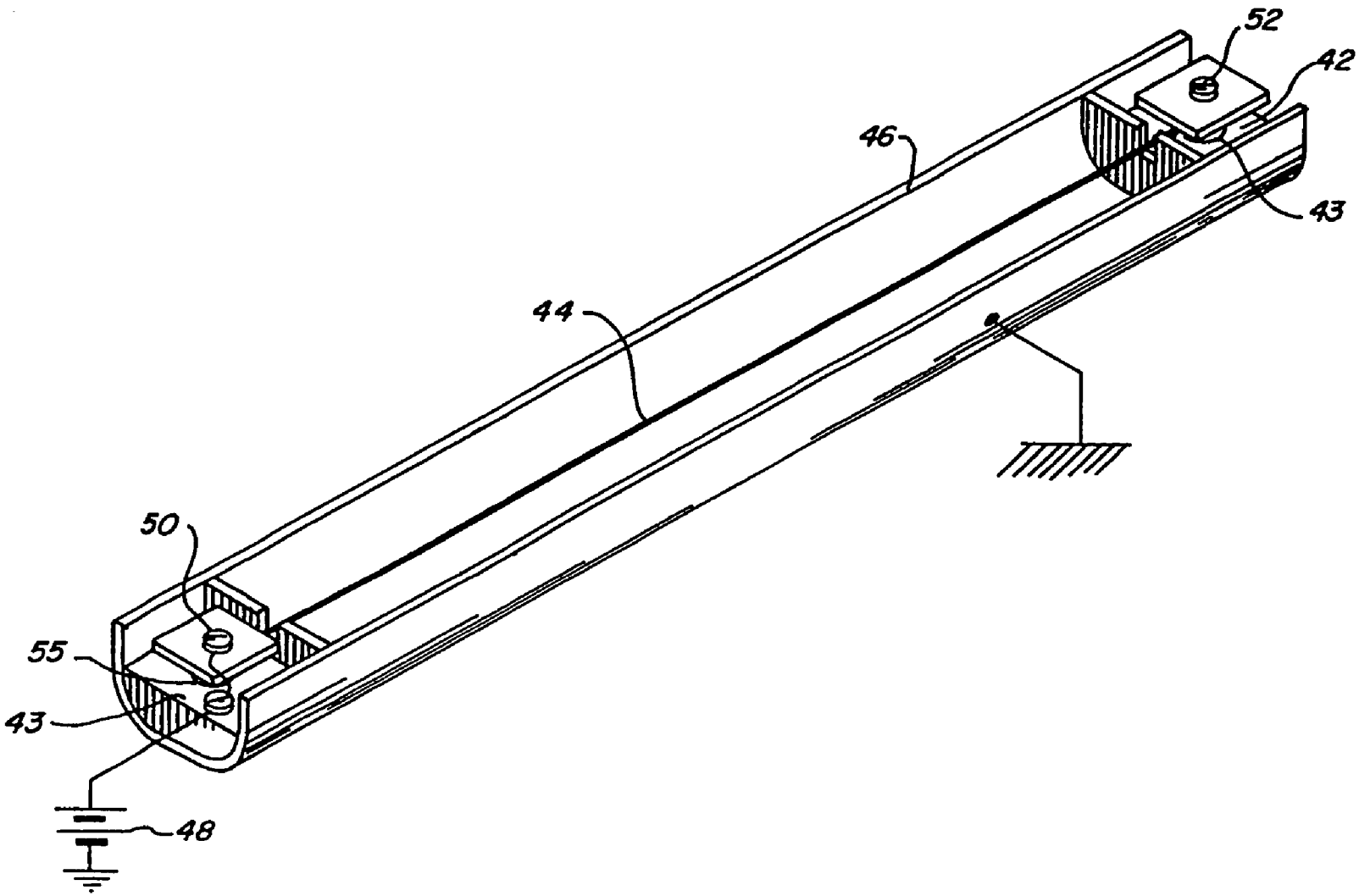
FIG. 3 is an isometric view of another exemplary embodiment of a corotron according to the present invention.

FIG. 3 illustrates an exemplary embodiment of a corotron device according to the present invention. In the corotron device, a wire 44 is supported between insulating end block assemblies 42 and 43 surrounded by a conductive corotron shield 46, which is grounded. The corona wire 44 at one end is fastened to port 52 in the end block assembly and at the other end is fastened to port 50 of the second end block assembly. The wire 44 at the second end of the corona generating device is connected to the corona potential generating source 48 by lead 55. The conductive corotron shield 46 may have a conductive coating of graphite and at least one transition metal oxide catalyst.

Figure 4:
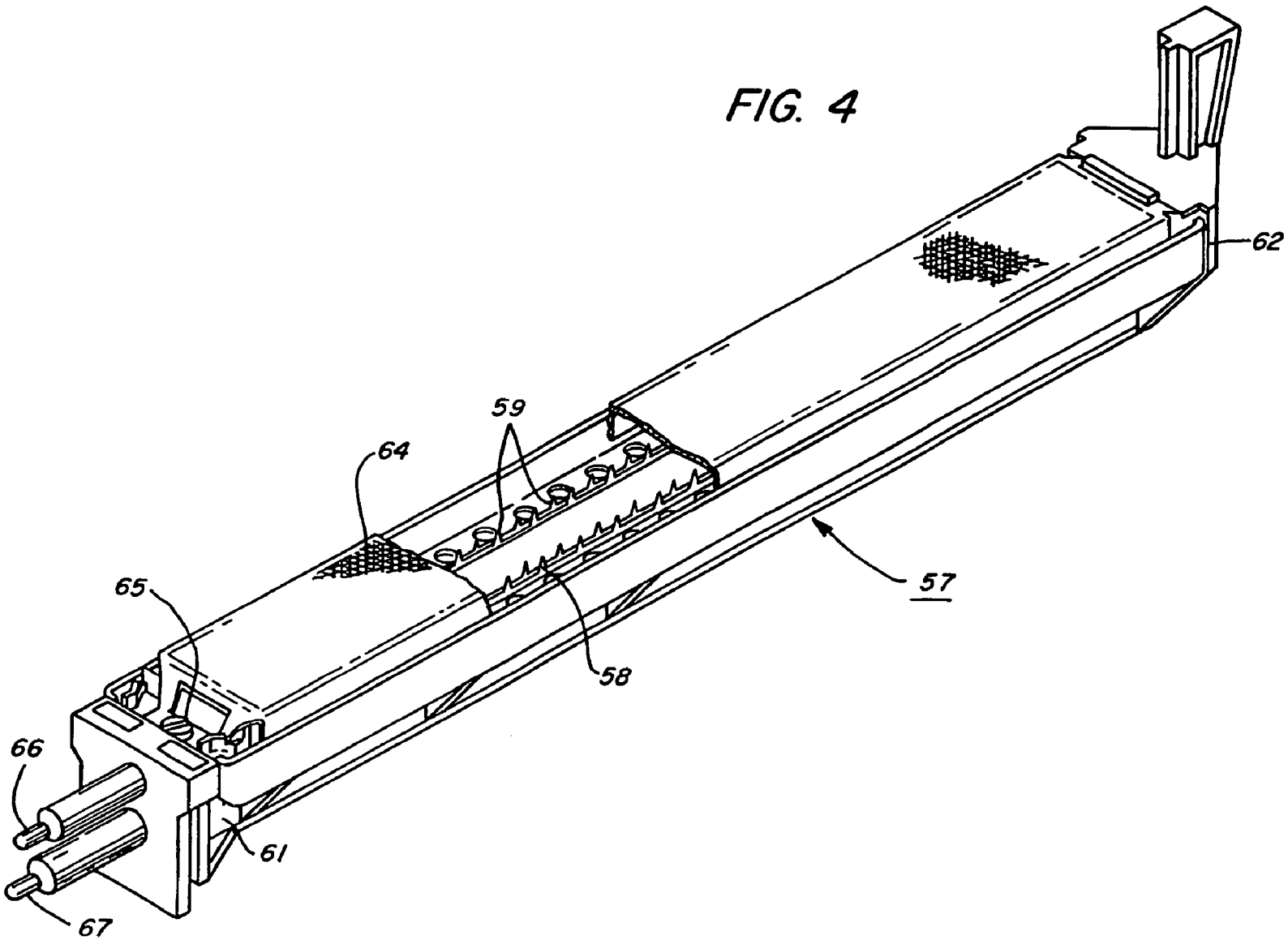
FIG. 4 is an isometric view of another exemplary embodiment of a scorotron according to the present invention.
Figure 5:
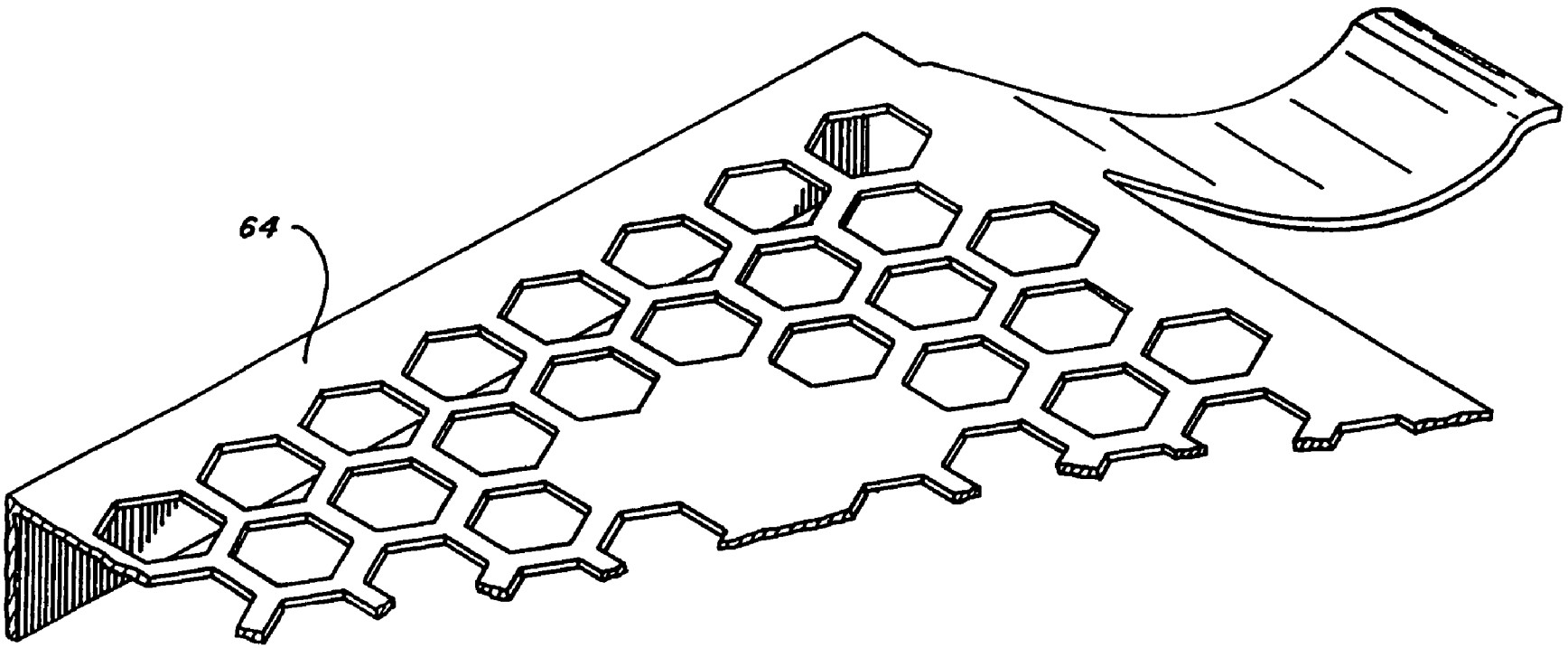
FIG. 5 is an enlarged view of the control grid used in the scorotron illustrated in FIG. 4.

FIGS. 4 and 5 illustrate an exemplary embodiment of the present invention in which the conductive corona control grid of a scorotron includes a conductive coating. In FIG. 4, scorotron 57 is represented as including two linear pin electrode arrays 58 and 59 supported between insulating end block assemblies 61 and 62. The conductive corona control grid 64 is placed on top of the linear pin arrays and anchored in place by means of screw 65 to potential generating source by lead 66. Both of the linear pin electrode arrays 58 and 59 are connected to potential generating source 67. Such a device might have utility as a negative charging corona generating device wherein the potential from a high voltage DC power supply applied to the grid is about −800 volts or very close to the voltage desired on the imaging surface which is closely spaced therefrom. The potential applied to the two linear pin electrode arrays is in the range of from about −6,000 to about −8,000 volts. The entire assembly is supported by being clamped between three injection molded plastic support strips. In this configuration the two linear pin coronodes in the shape of a saw tooth provide vertically directional fields and currents due to their geometry providing a higher efficiency of current to the photoconductor versus the total current generated. The grid acts as a leveling device or reference potential limiting the potential on the substrate being charged. In accordance with the present invention, the grid may be coated with a conductive coating of graphite and at least one transition metal oxide catalyst.

As pointed out above, the conductive coatings according to the present invention and the charging devices employing those coatings have the advantage of successfully scavenging ozone and neutralizing nitrogen oxides formed during the charging operation, without employing nickel powder, which is known to be a health and environmental hazard. Furthermore, the conductive coatings according to the present invention do not employ aluminum hydroxide, which is known to cause difficulties in production due to its propensity to form irreversible gels with polymeric binders present in various graphite dispersions. Further, these coatings have the distinct advantage of being easily prepared from readily commercially available components, and may be applied by simple brushing, spraying or dipping techniques without the use of extensive and expensive equipment. In addition, the present coatings provide durable corrosion resistant, water resistant, adherent coatings on the surface to which they are applied.

This invention is illustrated by the following Example, which is merely for the purpose of illustration.

EXAMPLE

To test the efficiency of the conductive coatings according to the present invention, a conductive coating dispersion is prepared and coated on to steel coupons. The steel coupons are then subjected to conditions simulating the conditions present in a corona generating device, and the performance of the coating is compared to the performance of known coatings.

A conductive coating dispersion is prepared by combining the graphite dispersion ROLLIT DS 8832 MT, the catalyst MOLECULITE, the aqueous sodium silicate solution K and water. The MOLECULITE used in this Example is obtained in pellet-form, and pulverized prior to combination with the other components of the coating dispersion.

The above components are combined in a weight ratio of 42% ROLLIT DS 8832 MT, 14% MOLECULITE, 2% aqueous sodium silicate and 42% water. The components are mixed in a high shear mixer for 10 minutes to obtain a conductive coating dispersion. The resulting conductive coating dispersion is applied to steel coupons by spray coating. When the conductive coating dispersion dries, the coupons are subjected to testing in a device simulating the conditions present in a corona generating device. After 300 hours of testing, the conductive coating performs as well known conductive coatings including nickel and aluminum hydroxide. With no signs of degradation in performance.

While this invention has been described in conjunction with the exemplary embodiments and Example outlined above, various alternatives, modifications, variations, improvements, and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the claims as filed and as they may be amended are intended to embrace all known or later developed alternatives, modifications, variations, improvements, and/or substantial equivalents.

What is claimed is:

1. A conductive coating, formed from an aqueous medium, and coating an element of a corona generating device in a xerographic system, the coating consisting essentially of graphite, at least one transition metal oxide catalyst, and a humidity tolerance-enhancing agent comprising less than 10 weight percent of the aqueous medium.

2. The conductive coating of claim 1, wherein the at least one transition metal oxide catalyst comprises at least one transition metal oxide catalyst selected from the group consisting of manganese dioxide and copper oxide.

3. The conductive coating of claim 2, wherein the at least one transition metal oxide catalyst comprises manganese oxide and copper oxide.

4. The conductive coating of claim 1, wherein the humidity tolerance-enhancing agent is at least one agent selected from the group consisting of sodium silicate and potassium silicate.

5. The conductive coating of claim 1, having a thickness of at least about 5 microns.

6. The conductive coating of claim 1, having a thickness of from about 20 to about 30 microns.

7. A corona generating device comprising at least one element comprising the conductive coating of claim 1.

8. The corona generating device of claim 7, wherein the corona generating device is selected from the group consisting of a corotron, a dicorotron and a scorotron.

9. The corona generating device of claim 8, wherein the at least one element comprises a conductive shield which substantially surrounds a corona discharge electrode.

10. The corona generating device of claim 8, wherein the at least one element comprises an insulating housing.

11. The corona generating device of claim 8, wherein the at least one element comprises a conductive corona control grid.

12. An image forming apparatus comprising the corona generating device of claim 7.

13. A conductive coating that coats an element of a corona generating device in a xerographic system formed by:

combining an aqueous graphite dispersion, at least one transition metal oxide catalyst, and a humidity tolerance-enhancing agent comprising less than 10 weight percent of a resultant aqueous medium;

applying the aqueous medium to a substrate; and driving water from the aqueous medium to form the coating.

14. A method of forming a conductive coating that coats an element of a corona generating device in a xerographic system comprising:

combining an aqueous graphite dispersion, at least one transition metal oxide catalyst, and a humidity tolerance-enhancing agent comprising less than 10 weight percent of a resultant aqueous medium;

applying the aqueous medium to a substrate; and driving water from the aqueous medium.

15. The method of claim 14, wherein combining an aqueous graphite dispersion and at least one transition metal oxide catalyst to create an aqueous medium further comprises combining water.

16. The method of claim 14, wherein applying the aqueous medium to a substrate comprises applying the aqueous medium in a quantity sufficient to provide a conductive coating having a thickness of at least about 5 microns.

17. The method of claim 14, wherein applying the aqueous medium to a substrate comprises applying the aqueous medium in a quantity sufficient to provide a conductive coating having a thickness of from about 20 to about 50 microns.

18. The method of claim 14, wherein applying the aqueous medium to a substrate comprises applying the aqueous medium in a quantity sufficient to provide a conductive coating that is substantially continuous.

* * * * *